US009705241B2

(12) United States Patent
Wu et al.

(10) Patent No.: US 9,705,241 B2
(45) Date of Patent: Jul. 11, 2017

(54) MANUFACTURING METHOD OF A CABLE CONNECTOR ASSEMBLY

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/797,490

(22) Filed: Jul. 13, 2015

(65) Prior Publication Data

US 2016/0013581 A1 Jan. 14, 2016

(30) Foreign Application Priority Data

Jul. 11, 2014 (CN) ..... 2014 1 0329228

(51) Int. Cl.

| | |
|---|---|
| ***H01R 13/58*** | (2006.01) |
| ***H01R 13/6585*** | (2011.01) |
| ***H01R 107/00*** | (2006.01) |
| ***H01R 24/60*** | (2011.01) |

(52) U.S. Cl.

CPC ..... *H01R 13/5845* (2013.01); *H01R 13/6585* (2013.01); *H01R 24/60* (2013.01); *H01R 2107/00* (2013.01)

(58) Field of Classification Search

CPC ..... H01R 13/5845; H01R 13/6658; H01R 13/6585; H01R 24/60; H01R 43/205

See application file for complete search history.

(56) References Cited

U.S. PATENT DOCUMENTS

| | | | | |
|---|---|---|---|---|
| 7,077,684 | B2 * | 7/2006 | Sasame | H01R 13/6658 439/350 |
| 7,329,151 | B2 * | 2/2008 | Wu | H01R 13/5808 439/456 |
| 7,614,913 | B2 * | 11/2009 | Ice | H01R 13/648 439/607.05 |
| 7,618,293 | B2 * | 11/2009 | Wu | H01R 24/62 439/493 |
| 7,762,844 | B2 * | 7/2010 | Ice | H01R 13/648 439/607.2 |
| 7,922,536 | B2 * | 4/2011 | Zhang | H01R 13/6583 439/607.45 |
| 8,070,525 | B2 * | 12/2011 | Hou | H01R 13/506 439/660 |
| 8,430,693 | B2 * | 4/2013 | Wu | H01R 13/6658 439/607.5 |
| 8,821,181 | B1 | 9/2014 | Lam et al. | |

(Continued)

*Primary Examiner* — Amy Cohen Johnson
*Assistant Examiner* — Oscar C Jimenez
(74) *Attorney, Agent, or Firm* — Wei Te Chung; Ming Chieh Chang

(57) ABSTRACT

A method of manufacturing a cable connector assembly including the steps of: connecting a mating member to a cable through an internal printed circuit board; enclosing a shell over the mating member and the cable; fixing a number of dowel pins to the shell; molding a strain relief over the shell; removing the dowel pins to form a number of pinholes in the strain relief; and telescoping an outer over-mold on the strain relief along a front-to-back direction.

20 Claims, 10 Drawing Sheets

(56) References Cited

U.S. PATENT DOCUMENTS

| | | | | |
|---|---|---|---|---|
| 2012/0071022 | A1 | 3/2012 | Su et al. | |
| 2012/0125661 | A1 | 5/2012 | Su et al. | |
| 2012/0125662 | A1 | 5/2012 | Su et al. | |
| 2012/0270448 | A1* | 10/2012 | Tziviskos | H01R 12/724 439/660 |
| 2014/0073185 | A1 | 3/2014 | Siahaan et al. | |

* cited by examiner

MANUFACTURING METHOD OF A CABLE CONNECTOR ASSEMBLY

BACKGROUND OF THE INVENTION

1. Field of the Invention

The present invention relates to a method of manufacturing a cable connector assembly, especially to forming a strain relief thereof.

2. Description of Related Art

US 2012/0071022, published on Mar. 22, 2012, discloses a cable connector assembly. The cable connector assembly includes a mating member connected through an internal printed circuit board to a cable, a shielding shell enclosing the mating member, a strain relief over-molded upon the shielding shell, and an outer boot telescoped on the strain relief. A first part of the strain relief encloses a ring portion of the shielding shell and a second part of the strain relief encloses the cable. During forming the strain relief, the shielding shell and the cable may drift due to high pressure. The strain relief may become uneven, certain part thereof being thick while another part thereof being thin. This unevenness will affect adhesion of the outer boot to the strain relief.

US 2012/0125661, published on May 24, 2012, discloses a strain relieving element including: a front surface, a rear surface opposite to the front surface, an intermediate portion connecting the front surface to the rear surface, a receiving passage passing through the front surface and the rear surface, a plurality of through cavities recessing inwardly from the intermediate portion and communicated with the receiving passage, and a plurality of the notches recessing inwardly from the intermediate portion and apart from the receiving passage. The through cavities and the notches increase bending degree of the strain relieving element.

An improved manufacturing method of a cable connector assembly is desired.

SUMMARY OF THE INVENTION

An object of the present invention is to provide a manufacturing method of a cable connector assembly including an improved step of stably forming a strain relief thereof.

To achieve the above-mentioned object, a method of manufacturing a cable connector assembly comprises the steps of: connecting a mating member to a cable through an internal printed circuit board; enclosing a shell over the mating member and the cable; fixing a plurality of dowel pins to the shell; molding a strain relief over the shell; removing the dowel pins to form a plurality of pinholes in the strain relief; and telescoping an outer over-mold on the strain relief along a front-to-back direction.

Other objects, advantages and novel features of the invention will become more apparent from the following detailed description when taken in conjunction with the accompanying drawings.

DETAILED DESCRIPTION OF THE PREFERRED EMBODIMENT

Figure 1:
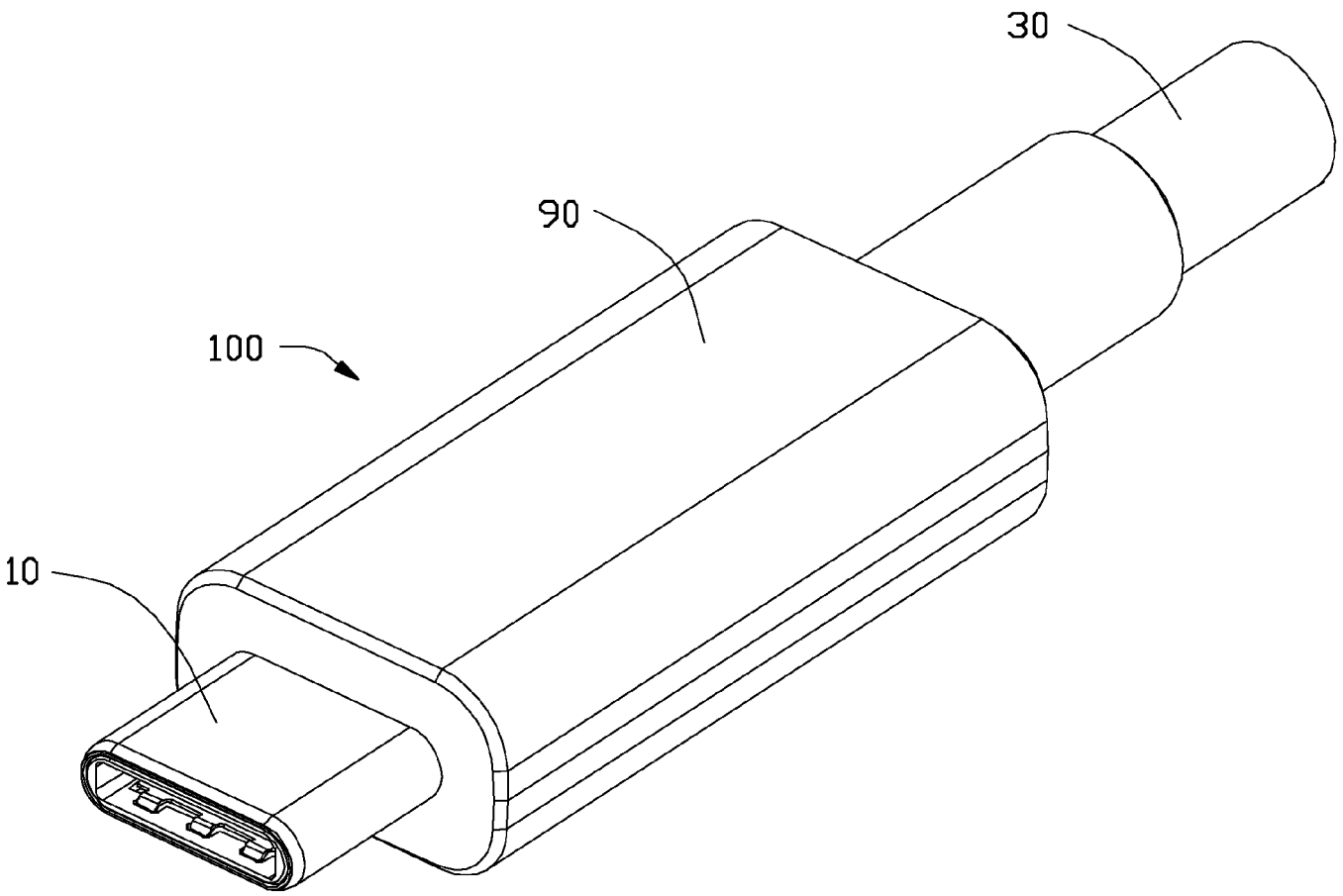
FIG. 1 is a perspective view of a cable connector assembly formed in accordance with the present invention.

Reference will now be made in detail to the preferred embodiment of the present invention.

Referring to FIGS. 1-5, a cable connector assembly, e.g., a plug connector assembly 100, formed in accordance with the present invention for mating with a mating connector (not shown), comprises a mating member 10, an internal printed circuit board (PCB) 20 disposed behind and electrically connecting with the mating member 10, a cable 30 including a plurality of wires, namely a first type of wires 31 and a second type of wires 32, electrically connected with the PCB 20, a spacer 4 for positioning the wires 31 and 32, a shell including a second shell 50 having a closed circumference and a third shell 60 also having a closed circumference, a strain relief 80, an inner over-mold on the second shell 50, and an outer mold or over-mold 90. The plug connector assembly 100 can be mated with the mating connector in two orientations.

Figure 7:
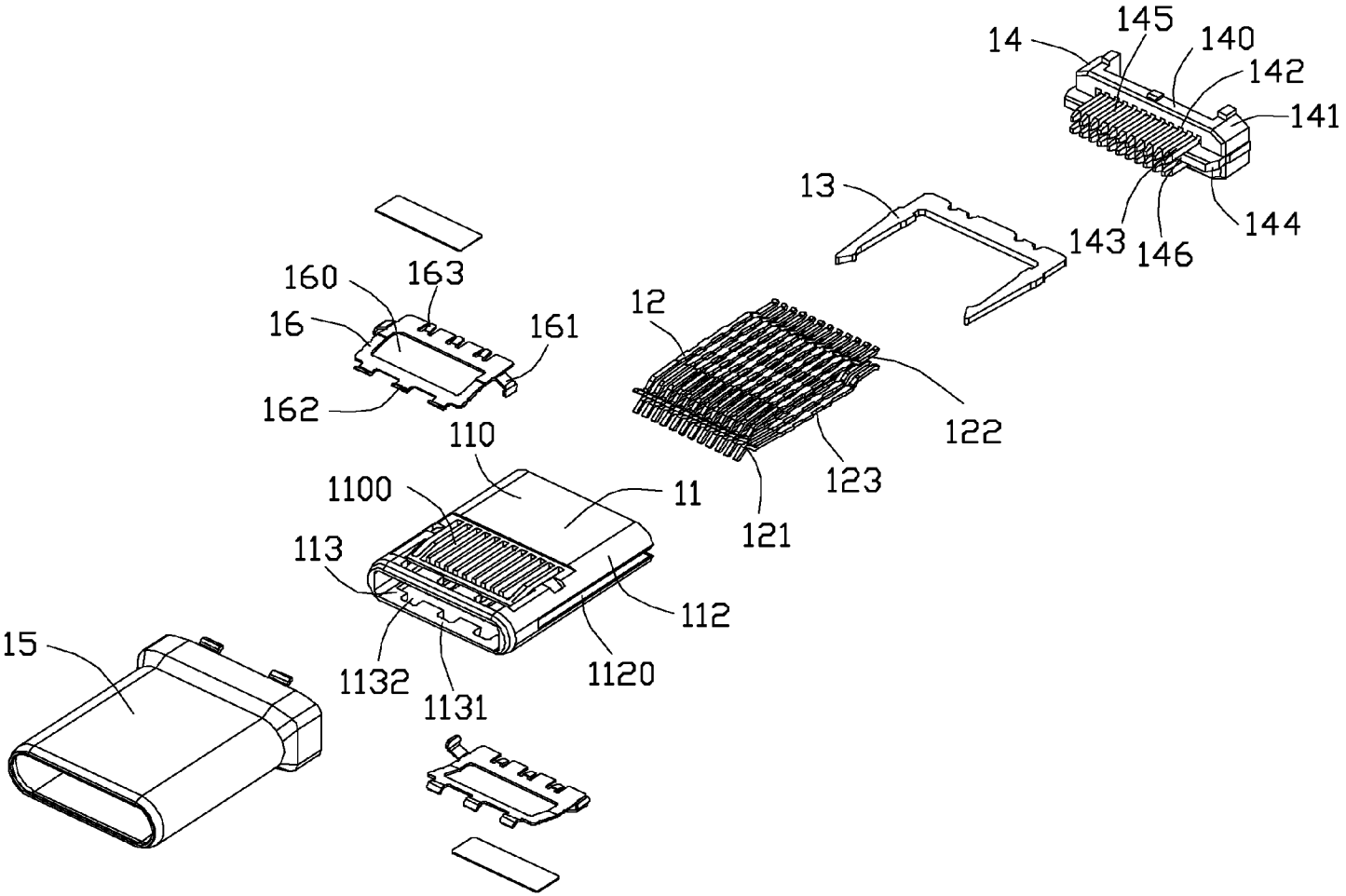
FIG. 7 is an exploded view further showing particularly a mating member of the cable connector assembly.
Figure 8:
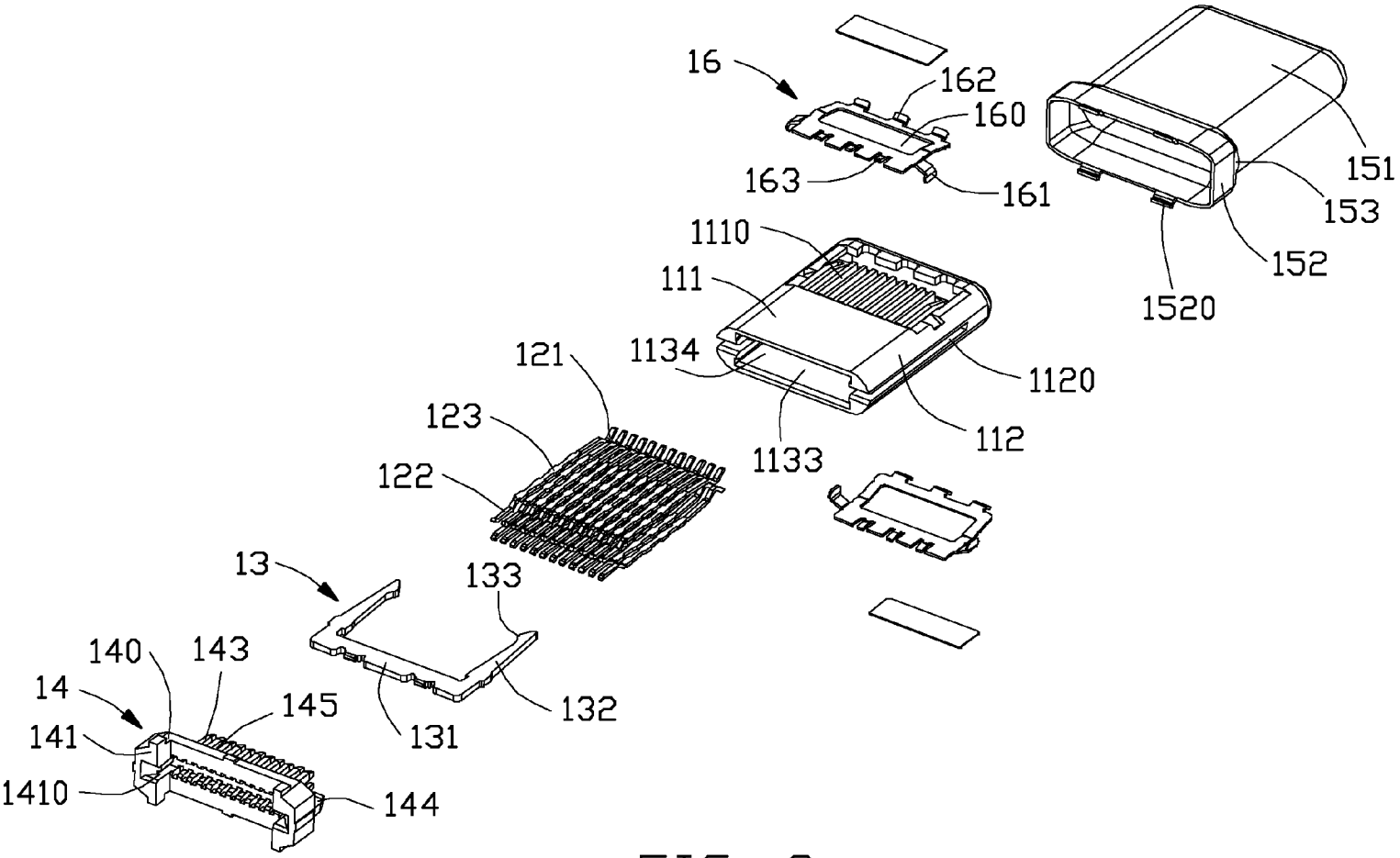
FIG. 8 is another exploded view of the mating member of FIG. 7.
Figure 9:
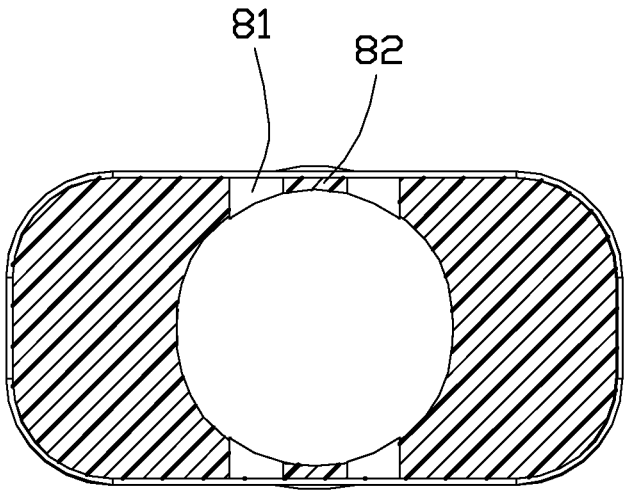
FIG. 9 is a cross-sectional view of the cable connector assembly taken along line 9-9 of FIG. 2 showing the strain relief only.
Figure 9A:
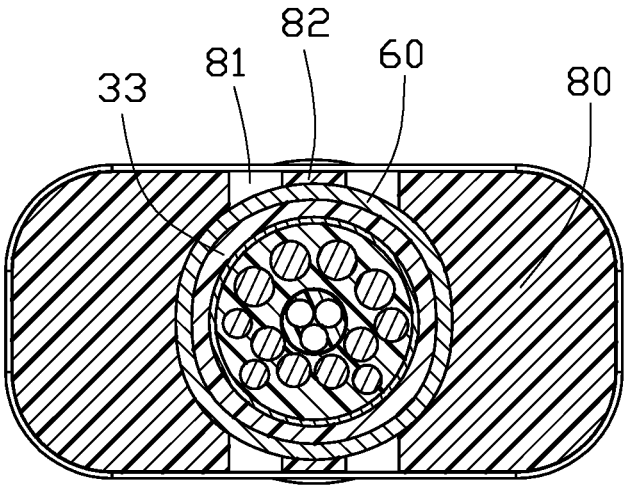
FIG. 9(A) is a cross-sectional view of the cable connector assembly taken along line 9-9 of FIG. 2.

Referring to FIGS. 7 and 8, the mating member 1 comprises an insulative housing 11, a plurality of first contacts 12 arranged in two rows and spaced apart from each other in a vertical direction, a latch 13 disposed between the two rows of contacts 12 for latching with the mating connector, an insulative member 14 disposed behind the insulative housing 11, a first shell 15 covering the insulative housing 11 and the insulative member 14, and a pair of grounding members 16 disposed on the insulative housing 11.

The insulative housing 11 comprises a top wall 110, a bottom wall 111 spaced apart from and parallel with the top wall 110, a pair of side walls 112 connecting the top wall 110 and the bottom wall 111, and a receiving room 113 surround by the top, bottom, and side walls. The receiving room 113 is divided into a front portion 1132 having a front opening 1131, and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113.

Each of the contacts 12 comprises a front mating portion 121 extending forwardly into the front portion 1132 of the receiving room 113, a rear mating portion 122 extending rearwardly, and an intermediate mounting portion 123 secured to the insulative housing 11. The front mating portion 121 is to be mated with the mating connector and the second mating portion 122 is to be mated with the PCB 20.

The front mating portions 121 of the two rows of contacts 12 are arranged face to face along the vertical direction.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction. The latch 13 is mounted into the insulative housing 11 through the rear opening 1133 of the rear portion 1134 of the receiving room 113. The base portion 131 abuts forwardly against the internal wall and the latch beams 132 are received into the side recesses 1120, respectively. At least a portion of each of the latch portions 133 projects into the front portion 1132 of the receiving room 113.

The insulative member 14 cooperates with the insulative housing 11 to fix the latch 13. The insulative member 14 comprises an insulative base portion 140, a pair of extending portions 141 extending rearwardly from two opposite ends, two rows of through holes 142 spaced apart in the vertical direction and extending through the insulative base portion 140 along a front to rear direction, two rows of posts 143 spaced apart in the vertical direction and extending forwardly, and a projected portion 144 extending forwardly between the two rows of posts 143. A channel 145 is formed between every two adjacent posts 143 of each row and is in communication with a corresponding one of the through holes 142. Each of the extending portions 141 defines a mounting slot 1410 extending along a rear to front direction. The posts 143 extend forwardly beyond the projected portion 144. A receiving slot 146 is formed between the two rows of posts 143. The insulative base portion 140 is thicker than the insulative housing 11. The insulative member 14 is mounted to the insulative housing 11 along a rear to front direction. The base portion 131 of the latch 13 is received into the receiving slot 146 of the insulative member 14, and the projected portion 144 is pressed against a rear side of the base portion 131. The rear mating portions 122 of the contacts 12 extend through the insulative member 140 by way of the channels 145, respectively.

The first shell 15 has a closed circumference so as to have a good sealing effect, a good anti-EMI performance, etc. The closed circumference of the first shell 15 could be manufactured by drawing a metal piece, bending a metal piece, die casting, etc. The first shell 15 comprises a first front end 151 for being inserted into the mating connector, a first rear end 152 for being mated with the first shell 51, and a first transition portion 153 for connecting to the first front end 151 and the first rear end 152. A diametrical dimension of the first front end 151 is smaller than a diametrical dimension of the first rear end 152. The first rear end 152 comprises a pair of latch tabs 1520 projecting outwardly.

One of the grounding members 16 is received into the top recess 1110, and the other one is received into the bottom recess 1110. Each of the grounding members 16 comprises a flat body portion 160, a pair of mounting portions 161 extending from two opposite ends of the flat body portion 160 and toward the insulative housing 11 for being attached to the insulative housing 11, a plurality of front grounding tabs 162 extending forwardly from a front side of the flat body portion 160 and entering into the front portion 1132 of the receiving room 113, and a plurality of rear grounding tabs 163 extending rearwardly from a rear side of the flat body portion 160. The front grounding tabs 162 are used for mating with the mating connector. The rear grounding tabs 163 are used for mating with the first shell 15. The front grounding tabs 162 of the pair grounding members 16 are disposed face to face along the vertical direction. A distance along the vertical direction between the front grounding tabs 162 of the pair of grounding members 16 is greater than a distance along the vertical direction of the front mating portions 121 of the two rows of contacts 12.

Figure 4:
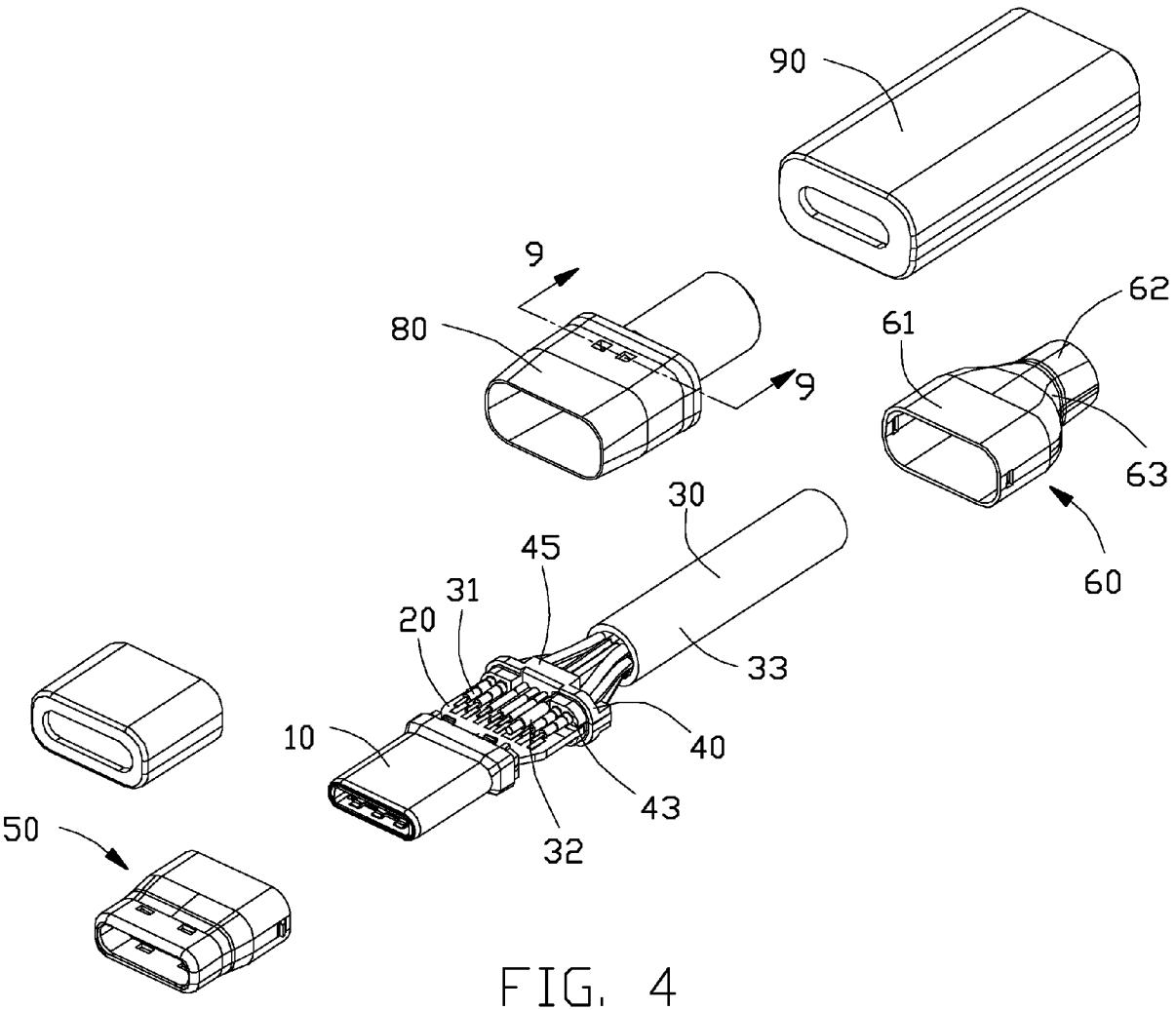
FIG. 4 is a further partially exploded view of the cable connector assembly as shown in FIG. 3.
Figure 5:
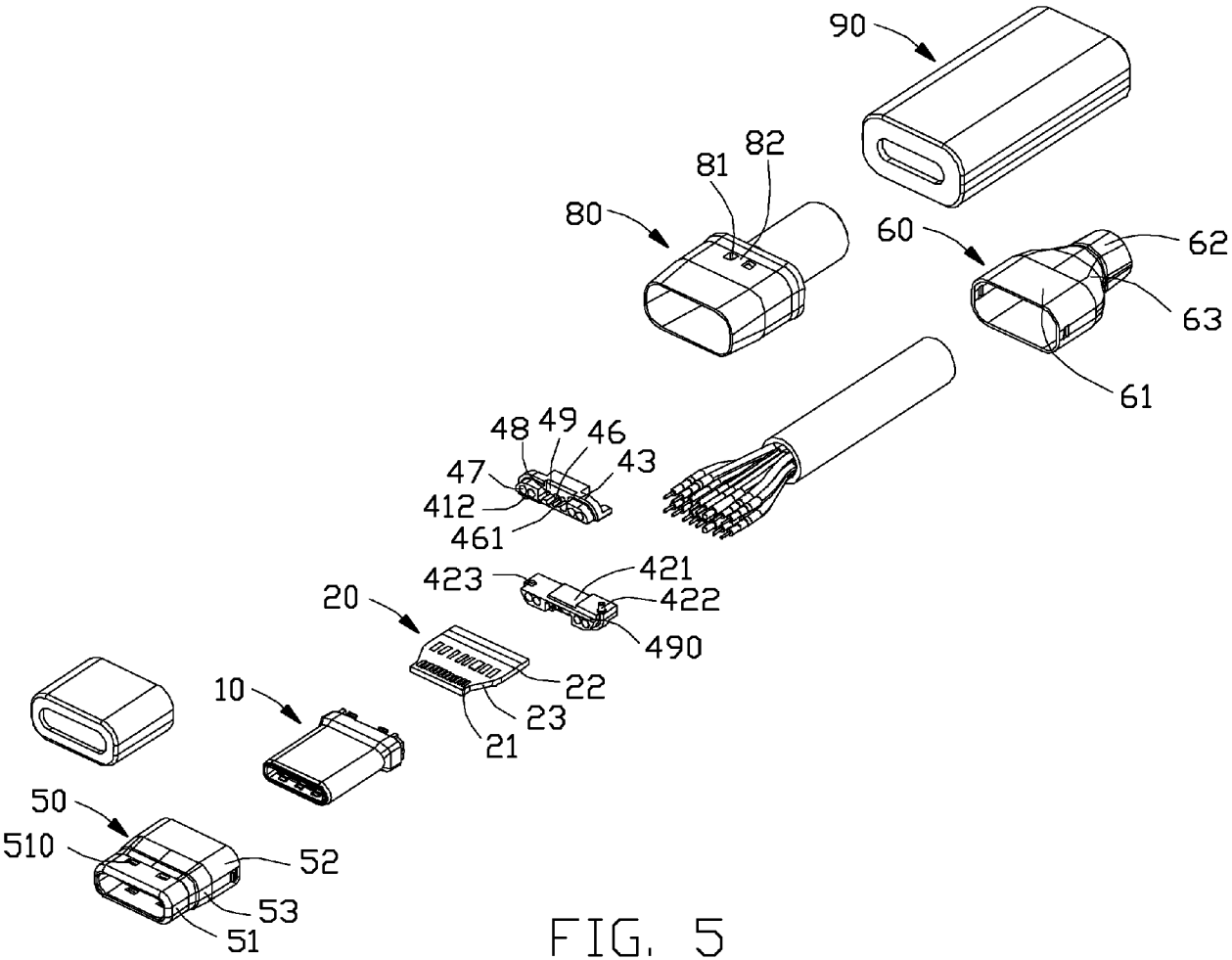
FIG. 5 is an exploded view of the cable connector assembly in FIG. 1.
Figure 6:
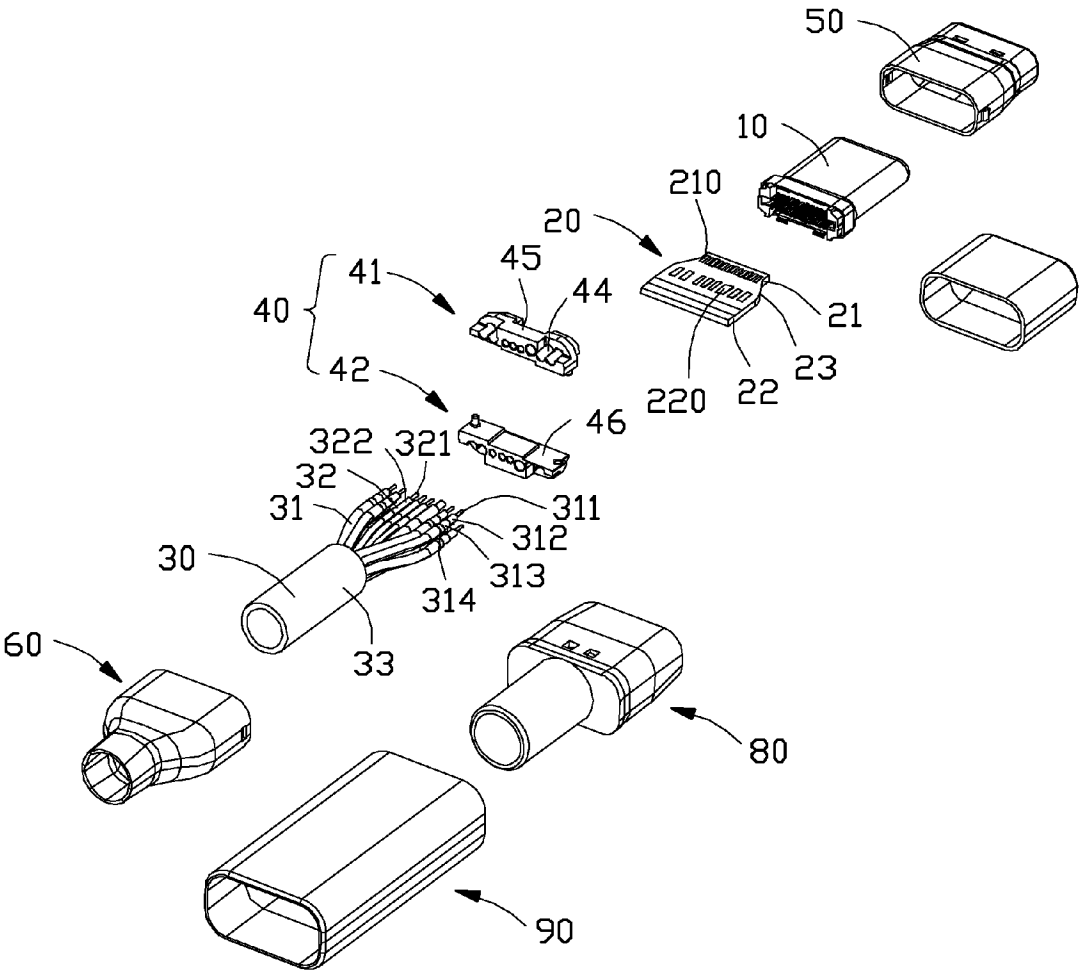
FIG. 6 is an exploded view of the cable connector assembly in FIG. 1 from another perspective.

Referring to FIGS. 4-6, the PCB 20 is disposed between the mating member 10 and the cable 30. The cable 30 is electrically connected with the contacts 12 by the PCB 20. The PCB 20 comprises a front portion 21, a rear portion 22, and a middle portion 23 connecting the front portion 21 and a rear portion 22. The front portion 21 is smaller than the rear portion 22 along a transverse direction. The front portion 21 of the PCB 20 is disposed between the rear mating portions 122 of the two rows of contacts 12. The PCB 20 comprises a plurality of front conductive pads 210 disposed on opposite side faces of the front portion 21 for electrically connecting with the rear mating portions 122 of the contacts 12, and a plurality of rear conductive pads 220 disposed on opposite side faces of the rear portion 22 for electrically connecting with the wires 31 and 32 of the cable 3. The PCB 20 is mounted to the insulative member 14 by the front portion 21 along the mounting slots 1410.

The cable 3 has a sheath 33 that contains multiple wires, e.g., two types of wires. Each cable wire 32 of a first type comprises a center conductor 321 and an outer jacket or dielectric 322 while each cable wire 31 of a second type comprises a center conductor 311, an inner dielectric 312, a braiding 313, and an outer jacket 314. Prior to connecting with the PCB 20, all layers of the wires other than possibly the center conductors need be removed. In this embodiment, the first type of wires 32 need to remove the dielectrics 322, e.g., in one operation, while the second type of wires 31 need to remove sequentially the outer jacket 314, braiding 313, and inner dielectric 312, e.g., in three operations.

Referring also to FIG. 5 and FIG. 6, the spacer 40 comprises an upper half 41 and a lower half 42 mounted to the upper half 41. Each spacer half has a front face 43, an opposite rear face 44, a top face 45, a bottom wall 46, and a plurality of through holes 47 and 48, each of the wires 31 and 32 of the cable 30 received in a corresponding through hole 47 or 48. The spacer 40 is further provided with a notch 49 at the junction of the top and front faces 45 and 43 or over the bottom wall 46. In this area of the notch 49, it can be seen that a wire positioning groove 461 is formed at the bottom wall 46 or is formed as a continuing part of the through holes 48. The spacer 4 is forwardly pressed against a rear side of the PCB 20. Posts 412, 422 and holes 413, 423 are correspondingly provided on the upper and lower halves 41 and 42 for proper engagement. The wires 31 and 32 of the cable 30 are divided into two rows by the upper and lower halves 41 and 42 for subsequent connection to the rear conductive pads 220 of the PCB 20. A respective step 490 is formed on each spacer half for engaging a rear edge of the PCB 20.

Referring to FIGS. 4-6, the second shell 50 has a closed circumference so as to have a good sealing effect, a good anti-EMI performance, etc. The second shell 50 includes a second frond end 51 telescoped with a rear end of the mating member 10, a second rear end 52 opposite to the second frond end 51, and a second transition portion 53 between the second front and rear ends. The second front end 51 is larger than the second rear end 52. The second front end 51 defines a pair of latch holes 510 latched with the latch tabs 1520 of the first shell 15, when the second shell 50 is telescoped on an outer side of the first rear end 152 of the first shell 15. The second front end 51 is interference fit with the first rear end 152 of the first shell 15. The second front end 51 of the second shell 50 and the first rear end 152 of the first shell 15 are further connected by laser welding in some spots or full circumference to have a good strength. The second rear end 52 is telescoped on an outer side of the spacer 40.

The third shell 60 has a closed circumference so as to have a good sealing effect, a good anti-EMI performance, etc. The closed circumference of the third shell 60 could be manufactured by drawing a metal piece, bending and forming a metal piece, die casting, etc. The third shell 60 comprises a main portion 61 telescoped with the second rear end 52 of the second shell 50, a ring portion 62 telescoped with the cable 30, and a third transition portion 63 between the main portion 61 and the ring portion 62. The main portion 61 is larger than the ring portion 62. In assembling, firstly, the third shell 60 is telescoped on the cable 30. The third shell 60 is moved forwardly and telescoped on the spacer 40, after the wires 31 and 32 are soldered on the rear conductive pads 220. Then, the third shell 60 is forwardly moved beyond the spacer 40 to latch with the second shell 50. The main portion 61 of the third shell 60 and the second rear end 52 of the second shell 50 are further connected by spot laser welding to have a good strength.

Figure 2:
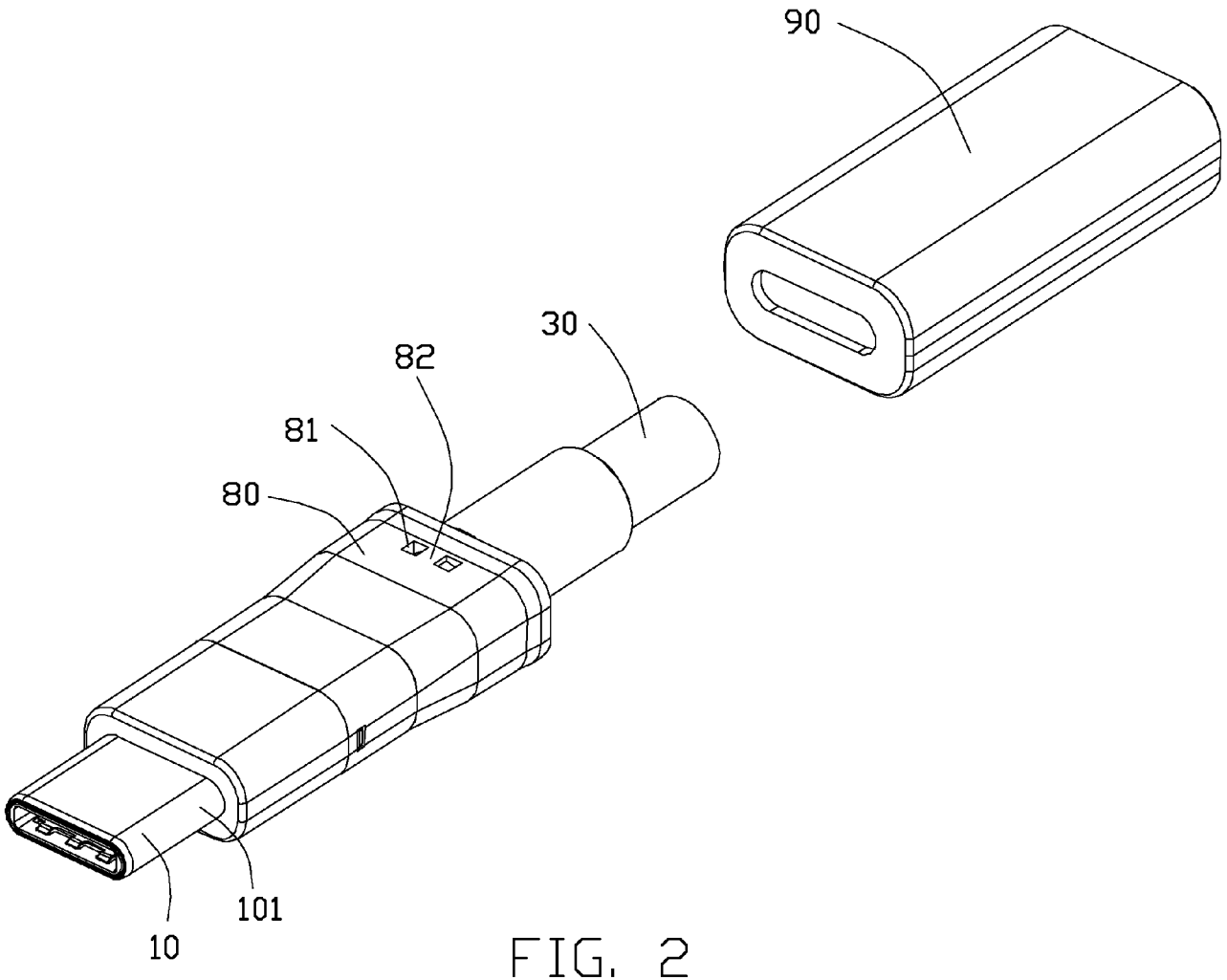
FIG. 2 is a partially exploded view of the cable connector assembly in FIG. 1.
Figure 3:
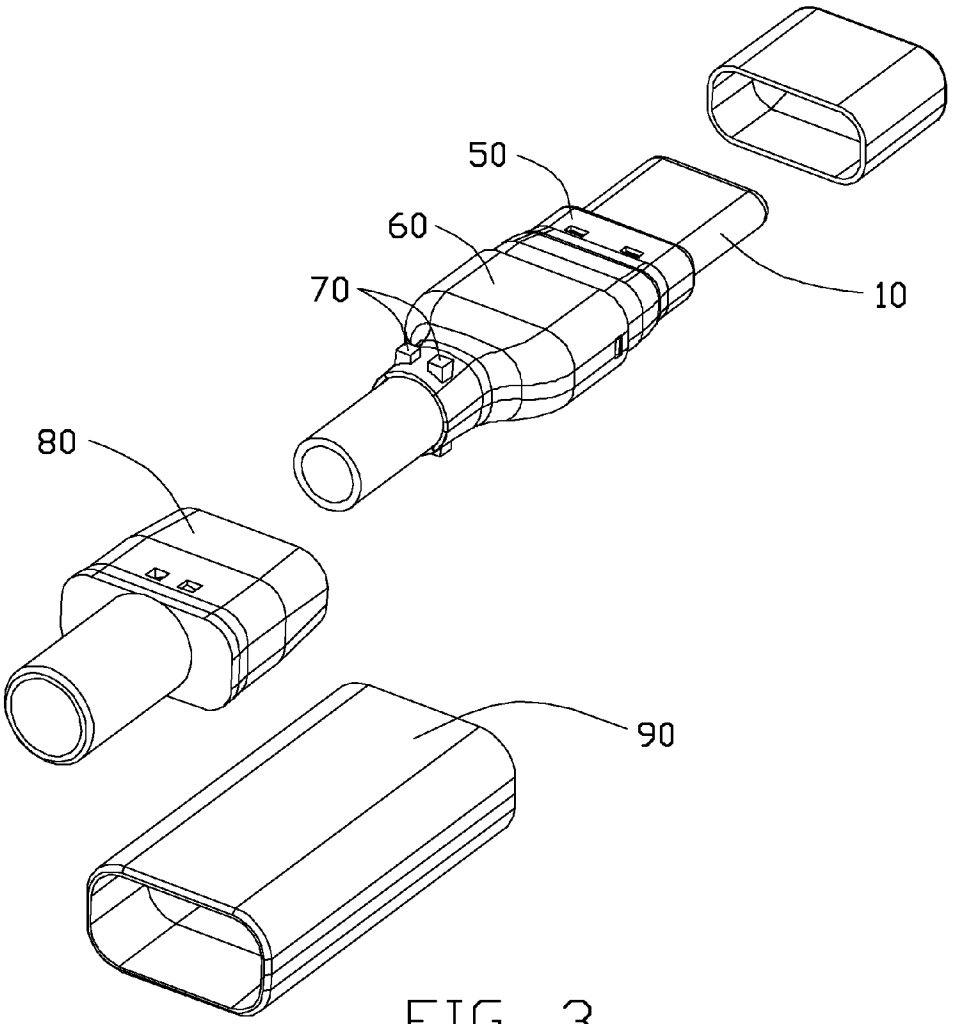
FIG. 3 is a further partially exploded view of the cable connector assembly as shown in FIG. 2.

Referring to FIGS. 2 and 3, the strain relief 80 is molded on the third shell 60 and the cable 30. Before forming the strain relief 80, a number of dowel pins 70 are needed. The dowel pins 70 are set on the mould. The dowel pins 70 include two pairs, one pair of the dowel pins 70 fixed upon a top of the ring portion 62 while the other pair of the dowel pins 70 fixed upon a bottom of the ring portion 62. Each of the dowel pins 70 has a curved end, the curved end fitting with the curved surface of the ring portion 62. The curved ends of the dowel pins extend to a side of the ring portion 62 to fix the cable 30 in left and right directions. When the dowel pins 70 fix the third shell 60, the strain relief 80 is formed uniformly. After the strain relief 80 is formed, the dowel pins 70 are lifted from the ring portion 62, then the strain relief 80 forms a number of pinholes 81. The pinholes 81 also have two pairs, one pair of the pinholes in an obverse face of the strain relief 80, the other pair of the pinholes in a reverse face of the strain relief 80. Two adjacent pinholes are connected by a connecting portion 82 in one pair of the pinholes. The connecting portion 82 increases bonding area of the outer over-mold 90 and the strain relief 80. The outer over-mold 90 is telescoped on the strain relief 80 along a front-to-back direction and fixed together by glue. Understandably, if the over-mold 90 is attached upon the strain relief 80 via another molding process alternately, the over-mold 90 may occupy the pin holes 81.

A method of manufacturing the cable connector assembly 100 comprises the steps of: connecting a mating member 10 and a cable 30 through an internal printed circuit board 20; enclosing a shell over the mating member 10 and the cable 30; fixing a plurality of dowel pins 70 to the shell; molding a strain relief 80 over the shell; removing the dowel pins 70 to form a plurality of pinholes 81 in the strain relief 80; and telescoping an outer over-mold 90 on the strain relief 80 along a front-to-back direction. Further, the fixing step comprises fitting a curved end of each dowel pin 70 with a curved surface of the shell; fixing a pair of dowel pins 70 upon the shell and another pair of dowel pins 70 down the shell; and extending the curved end of the dowel pin 70 to side of the shell to fix the cable 30 in left and right directions. Yet further, the telescoping step comprises fixing the outer over-mold 90 to the strain relief 80 by glue. Still further, the removing step comprises connecting two adjacent pinholes 81 by a connecting portion 82 to increase bonding area of the strain relief 80 and the outer over-mold 90.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A method of manufacturing a cable connector assembly, comprising the steps of:

connecting a mating member to a round cable through an internal printed circuit board;

enclosing a metallic shell over the mating member and the cable;

fixing a plurality of dowel pins to the shell;

molding a strain relief over the shell;

removing the dowel pins to form a plurality of pinholes in the strain relief; and telescoping an outer over-mold on the strain relief along a front-to-back direction; wherein the fixing step comprises fitting a curved end of each dowel pin with a curved surface of the shell, enclosing a sheath of said round cable.

2. The method as claimed in claim 1, wherein the fixing step comprises fixing a pair of dowel pins upon a top of the shell and another pair of dowel pins upon a bottom of the shell.

3. The method as claimed in claim 1, wherein the fixing step comprises fixing said curved end of each dowel pin to a side of the shell to hold the cable from left and right directions.

4. The method as claimed in claim 1, wherein the telescoping step comprises fixing the outer over-mold to the strain relief by glue.

5. The method as claimed in claim 1, wherein the removing step comprises forming two adjacent pinholes connected by a connecting portion to increase bonding area of the strain relief and the outer over-mold.

6. The method as claimed in claim 5, wherein said two adjacent pinholes are dimension in a transverse direction not to span beyond a diameter of the sheath of the round cable in a cross-sectional view.

7. The method as claimed in claim 1, wherein said shell has a closed circumference to have a good sealing effect.

8. An electrical cable connector comprising:

a mating member including an insulative housing with a plurality of contacts therein;

a round cable located behind the housing, in a front-to-back direction, having a sheath enclosing a plurality of wires with a front opening to have said plurality of wires, exposed to spread, to be electrically connected to the corresponding contacts, respectively;

a metallic shell enclosing a front portion of the sheath and the exposed wires; and an insulative strain relief formed and attached upon the shell via an insert molding process; wherein said strain relief forms a plurality of pinholes surrounding said shell to efficiently retain and center the shell with regard to the strain relief during said insert molding process; wherein said shell includes a rear cylindrical section enclosing the front portion of the sheath, and a front expansion section enclosing the spread wires, and each of said pinholes face forward the rear cylindrical section with a curved inner end.

9. The electrical cable connector as claimed in claim 8, wherein each of said pinholes extends in a vertical direction perpendicular to said front-to-back direction.

10. The electrical cable connector as claimed in claim 9, wherein said mating member defines a transverse direction which is perpendicular to both said front-to-back direction and said vertical direction, and the terminals are arranged with one another in two rows each extending along said transverse direction.

11. The electrical cable connector as claimed in claim 10, wherein two of said pinholes are side by side separated from each other in said transverse direction by a connecting portion of said strain relief.

12. The electrical cable connector as claimed in claim 11, wherein said two of the pinholes are dimensioned in said transverse direction not to span beyond a diameter of the rear cylindrical section of the shell in a cross-sectional view.

13. The electrical cable connector as claimed in claim 11, wherein said front expansion section and the rear cylindrical section of the shell are unitarily formed with each other via a drawing process to have a closed circumference with a good sealing effect.

14. The electrical cable connector as claimed in claim 8, further including an outer mold enclose a front portion of the strain relief to cover said pinholes.

15. The electrical cable connector as claimed in claim 8, wherein said shell further encloses said mating member.

16. A method of manufacturing a cable connector assembly, comprising steps of:

providing a mating member with a mating cavity to communicate with an exterior in a front-to-back direction;

disposing a plurality of terminals in the mating member;

providing a round cable with a sheath enclosing a plurality of wires with a front opening to expose and spread the wires;

electrically connecting the exposed wires with the corresponding terminals, respectively;

providing a metallic shell over a front portion of the cable;

forming and attaching an insulative strain relief upon the shell via an insert-molding process; and attaching an outer mold upon the strain relief; wherein the strain relief includes a plurality of pinholes intimately confronting the shell so as to efficiently retain the shell in position by a plurality of dowel pins located in the corresponding pinholes during said insert-molding process; wherein the shell includes a rear cylindrical section enclosing a front portion of the sheath, and a front expansion section enclosing the spread wires, and the pinholes face forward the cylindrical section with a curved end.

17. The method as claimed in claim 16, wherein said pinholes extends in a vertical direction perpendicular to said front-to-back direction.

18. The method as claimed in claim 16, wherein said pinholes are covered and filled by said outer mold via an over-molding process.

19. The method as claimed in claim 16, wherein said front expansion section and the rear cylindrical section of the shell are unitarily formed with each other via a drawing process to have a closed circumference with a good sealing effect.

20. The method as claimed in claim 16, wherein said outer mold is attached upon the strain relief by glue.

* * * * *